US010940383B2

(12) United States Patent
Starne

(10) Patent No.: US 10,940,383 B2
(45) Date of Patent: Mar. 9, 2021

(54) KNOT GAME

(71) Applicant: Jason Starne, Frisco, TX (US)

(72) Inventor: Jason Starne, Frisco, TX (US)

( * ) Notice: Subject to any disclaimer, the term of this patent is extended or adjusted under 35 U.S.C. 154(b) by 0 days.

(21) Appl. No.: 16/522,078

(22) Filed: Jul. 25, 2019

(65) Prior Publication Data

US 2020/0030688 A1 Jan. 30, 2020

Related U.S. Application Data

(63) Continuation-in-part of application No. 29/670,403, filed on Nov. 15, 2018.

(60) Provisional application No. 62/703,157, filed on Jul. 25, 2018.

(51) Int. Cl.

| | |
|---|---|
| ***A63B 69/00*** | (2006.01) |
| ***A63F 9/00*** | (2006.01) |
| ***A63B 67/10*** | (2006.01) |
| *A63B 43/00* | (2006.01) |

(52) U.S. Cl.

CPC ..... *A63F 9/00* (2013.01); *A63B 67/10* (2013.01); *A63B 43/00* (2013.01); *A63B 43/007* (2013.01)

(58) Field of Classification Search

CPC ..... A63F 9/00; A63B 67/10; A63B 43/007; A63B 43/00

USPC ..... 473/422–430, 458; 273/440; D21/446

See application file for complete search history.

(56) References Cited

U.S. PATENT DOCUMENTS 1,439,339 A * 12/1922 Smith ..... A63B 69/0079 473/147
1,513,773 A * 11/1924 Thompson ..... A63B 67/10 473/576
2,307,905 A * 1/1943 Ament ..... A01K 15/025 119/708
2,747,873 A * 5/1956 Carroad ..... A63B 69/0079 473/575
2,850,830 A * 9/1958 Halvorson ..... A01K 95/00 43/15
2,942,883 A * 6/1960 Moore ..... A63B 43/007 473/424
3,157,962 A * 11/1964 Bonnelly ..... A63B 43/007 446/247
3,502,337 A * 3/1970 Butkus ..... A63B 69/0079 473/147
3,843,134 A * 10/1974 Vallejo ..... A63F 9/0876 273/153 R
4,121,829 A * 10/1978 Petrusek ..... A63B 69/0086 473/576

(Continued)

OTHER PUBLICATIONS

YouTube Video https://www.youtube.com/watch?v=dlQtX9PwNqo "SwingAway Tether Assembly Part 1 of 2" by SwingAway Sports Products, published on Jun. 25, 2013.*

(Continued)

*Primary Examiner* — Mitra Aryanpour

(74) *Attorney, Agent, or Firm* — Braxton Perrone, PLLC; Bobby W. Braxton; Gregory Perrone

(57) ABSTRACT

A system and method for a knot game. The game includes a weight coupled to a flexible line. The flexible line has an upstream end and a downstream end which his coupled to the weight. The game includes gripping the flexible line at a position upstream from the weight. Thereafter, the weight is dropped and allowed to remove the slack in the line. Then a force is applied to create slack in the line in an attempt to tie a knot in the flexible line.

6 Claims, 8 Drawing Sheets

(56) References Cited

U.S. PATENT DOCUMENTS 4,884,807 A * 12/1989 Welch ..... A63B 43/00 473/575
D329,310 S * 9/1992 O'Rourke ..... D30/160
D330,100 S * 10/1992 O'Rourke ..... D30/160
5,452,888 A * 9/1995 Glenn ..... A63B 43/007 473/424
5,711,254 A * 1/1998 O'Rourke ..... A01K 15/026 119/710
6,044,800 A * 4/2000 Kubo ..... A01K 15/026 119/710
6,142,889 A * 11/2000 Schaubach ..... A63B 69/0079 473/415
6,733,405 B2 * 5/2004 Gormley ..... A63B 43/007 473/575
D514,753 S * 2/2006 Crane ..... D1/199
7,219,626 B2 * 5/2007 Hurwitz ..... A01K 15/025 119/707
7,543,550 B2 * 6/2009 Simpson ..... A01K 15/025 119/708
D653,819 S * 2/2012 Byrne ..... D30/160
D661,850 S * 6/2012 Byrne ..... D30/160
8,771,106 B1 * 7/2014 Boulanger ..... A63B 43/007 473/422
D728,171 S * 4/2015 Byrne ..... D30/160
9,114,284 B2 * 8/2015 Orr ..... A63B 43/00 473/575
D743,639 S * 11/2015 Byrne ..... D30/160
D747,834 S * 1/2016 Byrne ..... D30/160
2003/0224879 A1 * 12/2003 Hansberry ..... A63B 69/36 473/423
2004/0107917 A1 * 6/2004 Gerlach ..... A01K 15/026 119/708
2004/0116040 A1 * 6/2004 Mulvihill ..... A63H 3/02 446/247
2006/0094573 A1 * 5/2006 Weck ..... A63B 21/0552 482/126
2006/0217027 A1 * 9/2006 Martuccio ..... A41D 13/0015 446/46
2008/0085655 A1 * 4/2008 Boise ..... A63H 27/10 446/220
2009/0077856 A1 * 3/2009 Cagle ..... A01M 31/06 43/3
2012/0040782 A1 * 2/2012 Grabner ..... A63B 43/007 473/423
2012/0208657 A1 * 8/2012 Simpson ..... A63B 69/0079 473/424
2020/0030688 A1 * 1/2020 Starne ..... A63F 9/00 273/440

OTHER PUBLICATIONS

YouTube Video https://www.youtube.com/watch?v=dlQtX9PwNqo "SwingAway Tether Assembly Part 1 of 2" by SwingAway Sports Products, Published on May 27, 2014.*
Knot So Fast, www. thinkfun.com, published 2016.*
Knot Games for teaching, Apr. 1997 from scoutnet.uk.*

* cited by examiner

KNOT GAME

PRIORITY

The present invention claims priority to U.S. Provisional Application No. 62/703,157 filed on Jul. 25, 2018, as well as U.S. Design Application No. 29/670,403, filed Nov. 15, 2018, the entirety of both of which are hereby incorporated by reference.

BACKGROUND OF THE INVENTION

Technical Field

The present invention relates to a system and method for a game.

Description of Related Art

Many people experience anxiety or have nervous energy. This is one reason the fidget spinner was a commercial success. However, there is no reward or goal with the fidget spinner. Consequently, there is a need for a game which is fun and which has a goal.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
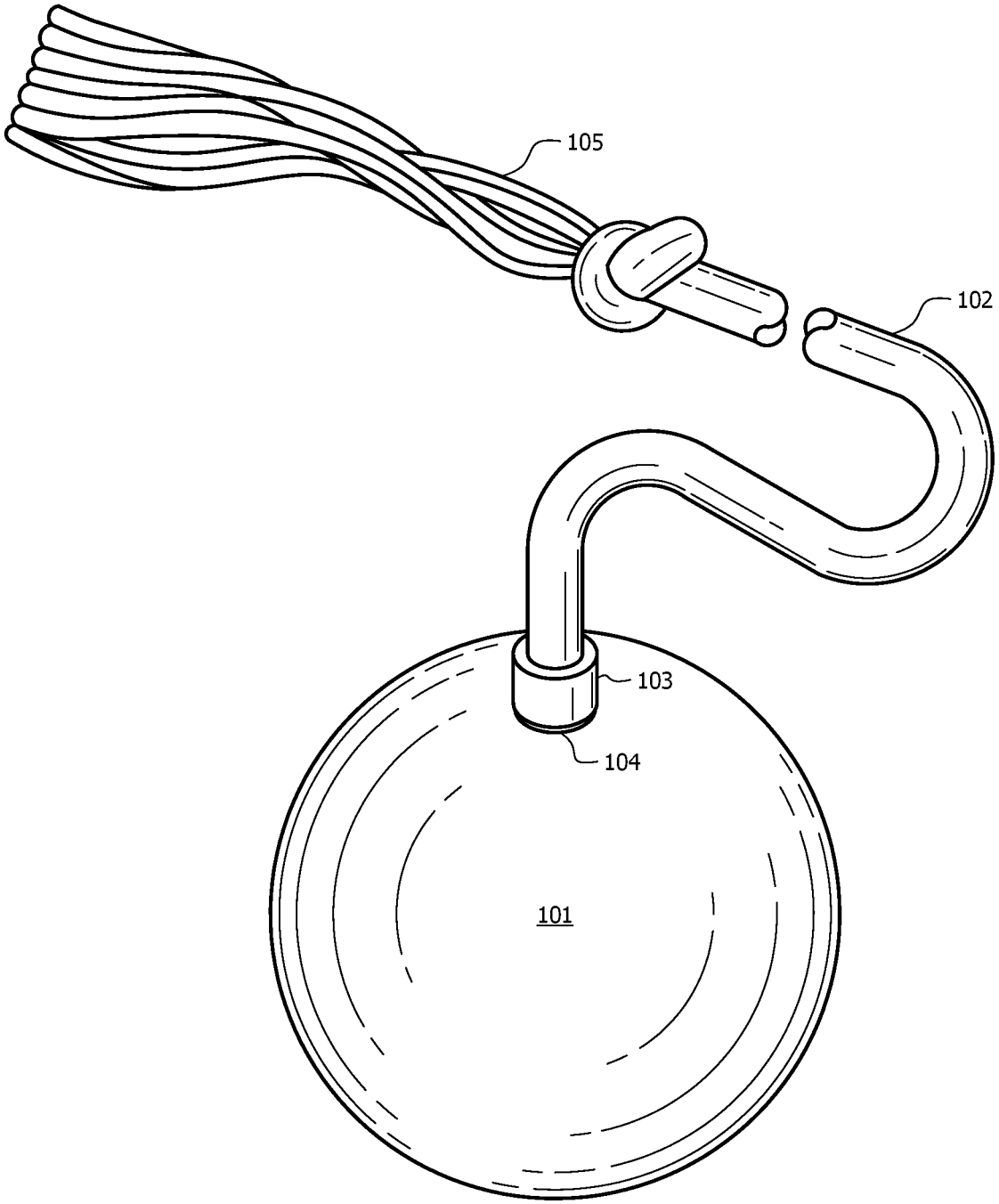
FIG. 1 is a perspective view of the knot game in one embodiment.
Figure 2:
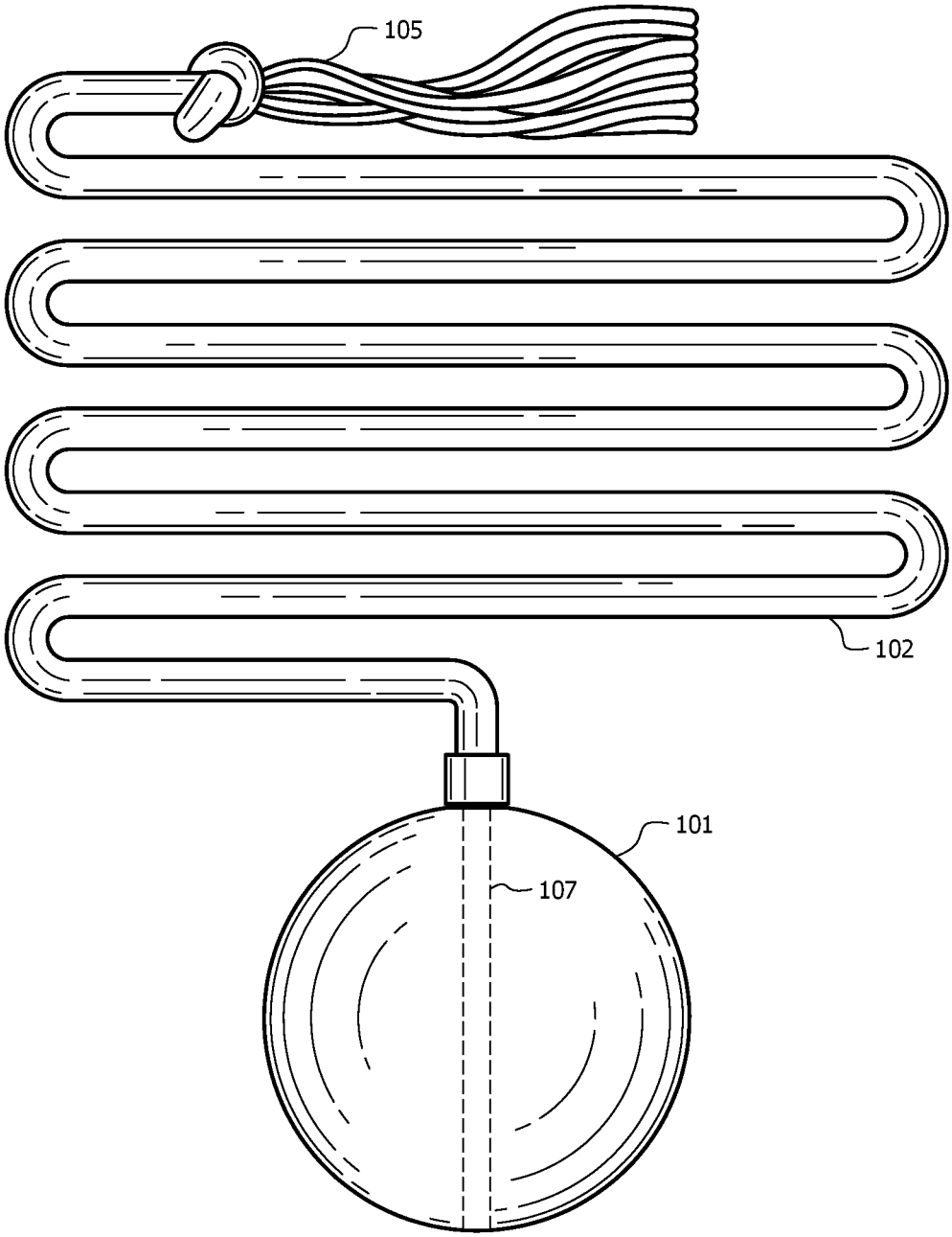
FIG. 2 is a perspective view of the knot game in one embodiment comprising a band.

FIG. 1 is a perspective view of the knot game in one embodiment. FIG. 2 is another perspective view of the weight in one embodiment comprising a band. The knot game 100, as depicted, includes a weight 101 coupled to a flexible line 102. As will be discussed, the game is played by having a user hold one end of the flexible line 102 and bouncing the weight 101 so that a knot is tied along the length of the flexible line 102.

As noted, the knot game 100 comprises a weight 101. The weight 101 can be any object which adds sufficient mass and weight to the game. The actual mass of the weight 101 can vary depending upon the gauge and thickness of the flexible line 102, then length of the flexible line 102, etc. In one embodiment the weight 101 weighs more than 5.3 ounces. In one embodiment the weight 101 has a weight between 5.3-6.3 ounces.

While the weight 101 is depicted as being a sphere, this is for illustrative purposes only and should not be deemed limiting. Virtually any shape can be utilized. As an example, a football, which is oblong in shape, can be used as the weight 101. Other shapes such as a cube, rectangle, pyramid, etc. can also be used.

Like the mass of the weight 101, the size can also vary depending upon several factors. The weight 101 can range from an effective diameter of about ½ inch to about 3 inches.

The weight 101 can comprise virtually any material. This can include, but is not limited to, rubber, plastic, wood, metal, and combinations thereof. As the weight 101 is going to be jostled and bounced, in one embodiment the weight 101 comprises a material which will not injure the user. Likewise, in one embodiment the weight 101 does not comprise sharp edges or corners which could injure the user or bystanders. Thus, in one embodiment the weight 101 comprises rounded and soft features. In one embodiment the weight 101 comprises a ball. In one embodiment the weight 101 comprises a rubber ball.

The weight 101 is downstream of a connector 103. As used herein, the terms upstream and downstream refer to relative locations on the knot game. The weight 101 is the furthest item downstream. Thus, the connector 103 is upstream of the weight 101.

The connector 103 connects the weight 101 to the flexible line 102. The connector 103 can comprise any device known in the art for coupling a flexible line 102 to an object. This can include a washer, a nut, etc. In one embodiment a portion of the flexible line 102 or the connector is drilled into the weight 101 and secured within. The weight 101 can be attached to the connector 103 via any method or device known in the art.

In one embodiment, and as depicted in FIG. 2, the connector 103 is coupled to a band 107 which surrounds the weight 101. The band 107 keeps the weight 101 firmly intact with the connector 103. The band 107 can comprise virtually any material, including flexible line, twine, string, fabric, wire, plastic, etc. While one embodiment has been shown which utilizes a band, this is for illustrative purposes only and should not be deemed limiting.

Figure 3:
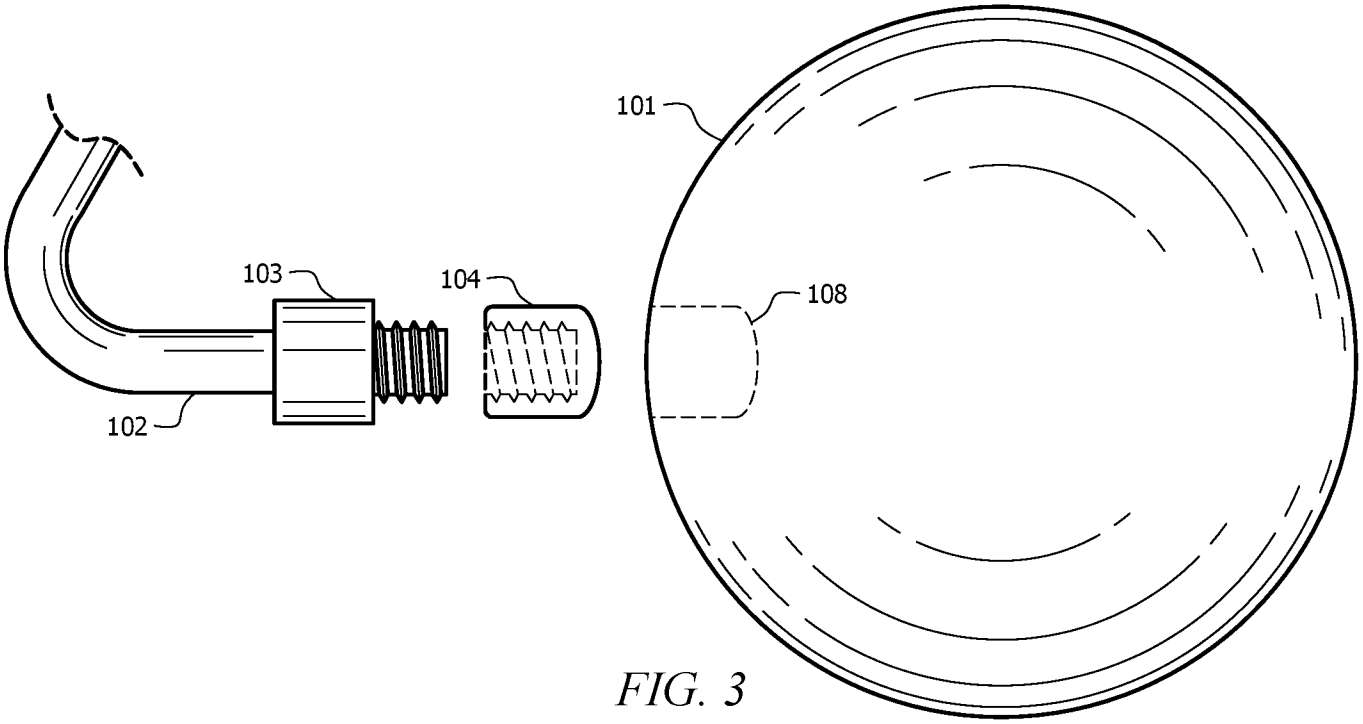
FIG. 3 is a schematic of a coupling system in one embodiment.

FIG. 3 is a schematic of a coupling system in one embodiment. As shown, the flexible line 102 is coupled to the connector 103. In this case, the connector 103 has an adapting device which can couple with a coupler 104. As shown, the connector 103 comprises a male threading and the coupler 104 comprises a complementary female threading which receives the male threading. Thus, the connector 103 is threadingly engaged with the coupler 104. The coupler 104 then couples with a receiver 108 located within the weight 101. The coupler 104 can be coupled to the receiver 108 via any method or device known in the art. In one embodiment adhesive, glue, or the like is used to attach the coupler 104 to the weight 101. In other embodiments the coupler 104 screws into the receiver 108. In still other embodiments the coupler 104 is secured via friction fitting. FIG. 3 shows but a single embodiment and should not be deemed limiting. While FIG. 3 depicts an intermediate coupler 104 which is downstream of the connector 103 but upstream of the weight 101, in other embodiment there is no such intermediate coupler 104. Rather, in such embodiments the connector 103 couples directly to the weight 101. In one embodiment, for example, the connector 103 comprises male threading and the receiver 108 is integrally made within the weight 101. Thus, threading can be carved into the interior of the receiver 108, and the male threading of the connector 103 will be received by the female threading of the receiver 108. Thus, in such embodiments there is no separate, and external, coupler 104.

Figure 8:
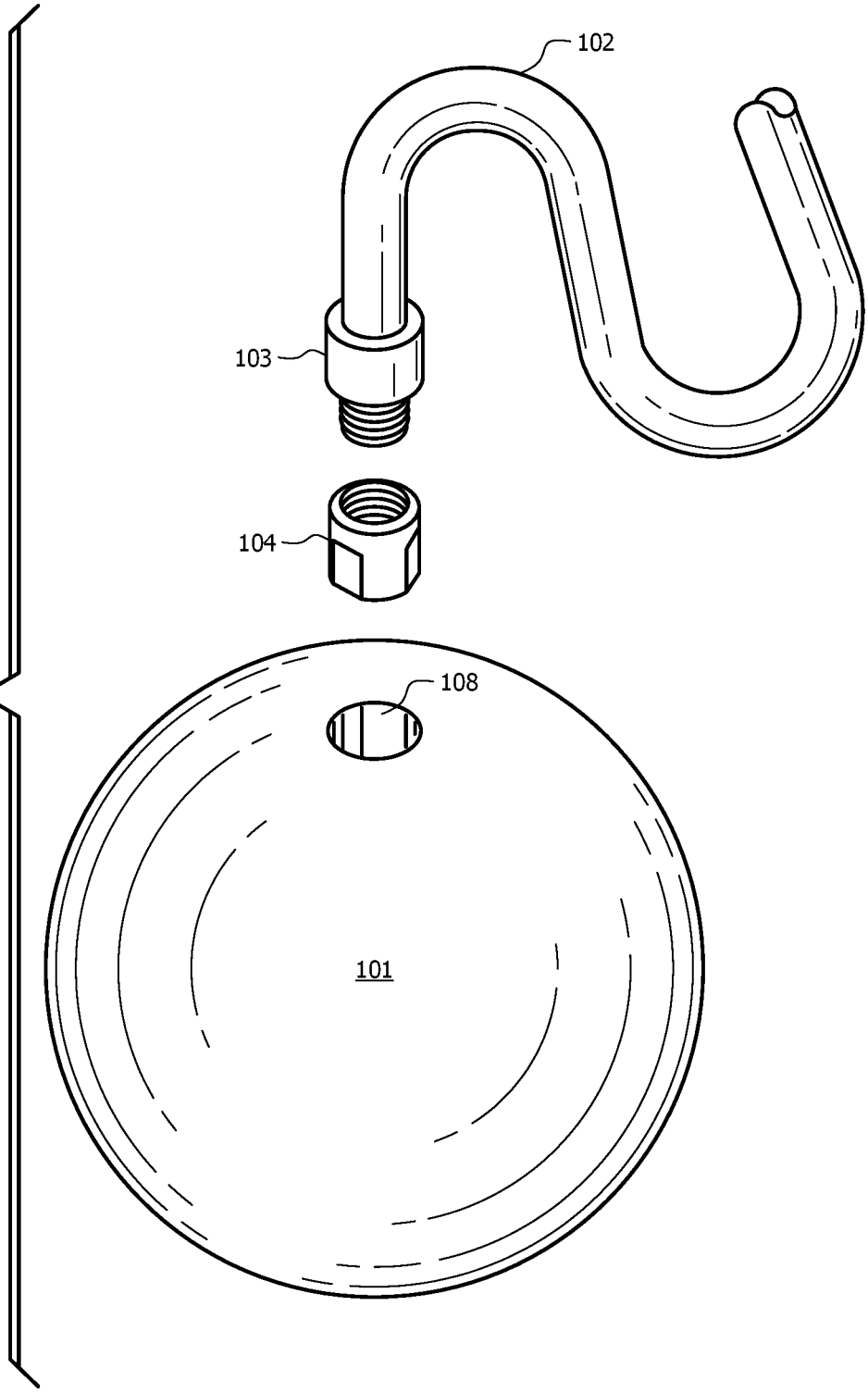
FIG. 8 is a perspective view of a coupling system in one embodiment.

Turning briefly to FIG. 8, FIG. 8 is a perspective view of a coupling system in one embodiment. FIG. 8 shows the receiver 108, the coupler 104 and the connector 103 in an exploded relationship. As noted, the coupler 104 can be adhered to the receiver 108 via friction, glue, adhesive, etc.

As noted, upstream of the connector 103 is the flexible line 102. A flexible line refers to an elongated and flexible line which can couple to an object. Examples of suitable materials for a flexible line can include, but is not limited to, rope, twine, string, fabric, wire, plastic, etc. In one embodiment the flexible line 102 is sufficiently flexible and non-rigid to allow a knot to be tied by a bouncing weight 101.

The length and thickness of the flexible line 102 can vary with the mass of the weight 101. Various lengths can be utilized. For example, certain games will comprise a longer length and are intended to be played with the user in the standing position. In other embodiments the flexible line 102 has a shorter length so that the user can play in the seated position. In one embodiment the flexible line 102 has a length of between about 32-33 inches.

In one embodiment the flexible line 102 has a varying thickness. As an example, the upstream end will comprise a thickness which decreases to the mid-point of the line 102 and then increases again moving downstream. Such changes alters the force and movements required to tie a knot. In one embodiment the flexible line 102 has a thickness of about 3/16 of an inch.

While the flexible line 102 has been described and depicted as a uniform material, this is for illustrative purposes only and should not be deemed limiting. The game can change when the material of the flexible line 102 has changed. Thus, as an example, the flexible line 102, in some embodiments, will comprise a rope which extends 90% of the length. The rope is then coupled to flexible line 102, which is elastic, which couples, either directly or indirectly, to the weight 101. The elasticity of the flexible line 102, or a portion of the flexible line 102, alters the way the force is distributed to the weight 101 and changes the motion and forces required to tie the knot. In other embodiments the elastic portion is on an upstream portion, a middle portion, or the downstream portion of the flexible line 102. In still other embodiments, the entire flexible line 102 is elastic. As noted, in other embodiments the flexible line 102 is generally inelastic.

As depicted, the upstream end 105 of the flexible line 102 is frayed. In the embodiment depicted, the flexible line 102 is rope, and the upstream end 105 has frayed endings. This allows the user an opportunity to braid the rope, play with the free ends, etc. The frayed ropes are simply an example and should not be deemed limiting.

Figure 4:
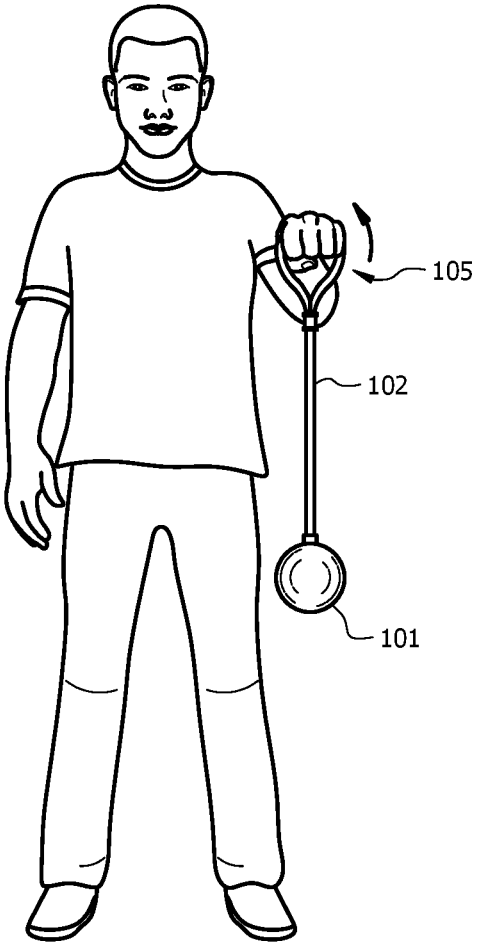
FIG. 4 is a side view of a user playing the knot game in one embodiment.
Figure 5:
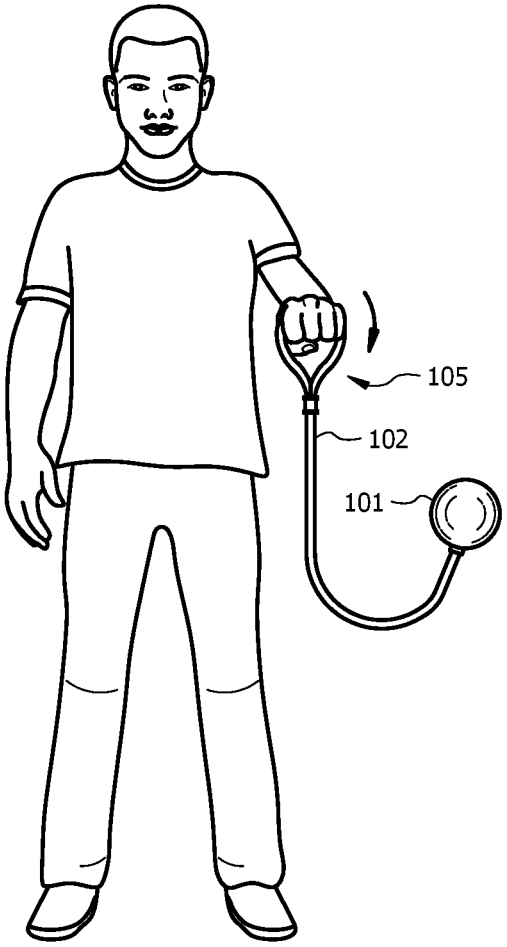
FIG. 5 is a side view of a user attempting to tie a knot in one embodiment.

Now that the knot game 100 has been described, a method of playing will be described. Turning now to FIGS. 4 and 5, FIGS. 4 and 5 are side view of a user playing the knot game in one embodiment. In FIG. 4, the user is grasping the upstream end 105 of the flexible line 102. Gravity, acting upon the weight 101, causes the weight 101 to pull upon and straighten the flexible line 102. To tie the knot, the user must provide an upward force to get the weight 101 to move upward. This causes slack in the flexible line 102. Slack is necessary to be able to tie a knot. In FIG. 5, a force has been applied causing the weight 101 to move in the upward direction causing slack in the flexible line 102.

To tie a knot, the weight 101 should move not only in the vertical plane but also the horizontal plane. Thus, the user jostles the flexible line 102 in such a manner to cause the weight 101 to bounce, move, and ultimately form a knot along the length of the flexible line 102. The user does not grasp the weight 101, and only controls the flexible line 102 at one location.

The user can alter the game, and change the physics required to tie a knot but moving the grip downstream and shortening the free flexible line 102. As used herein, "free flexible line" refers to the portion of the line which is downstream of the users grip and which is free to move.

Figure 6:
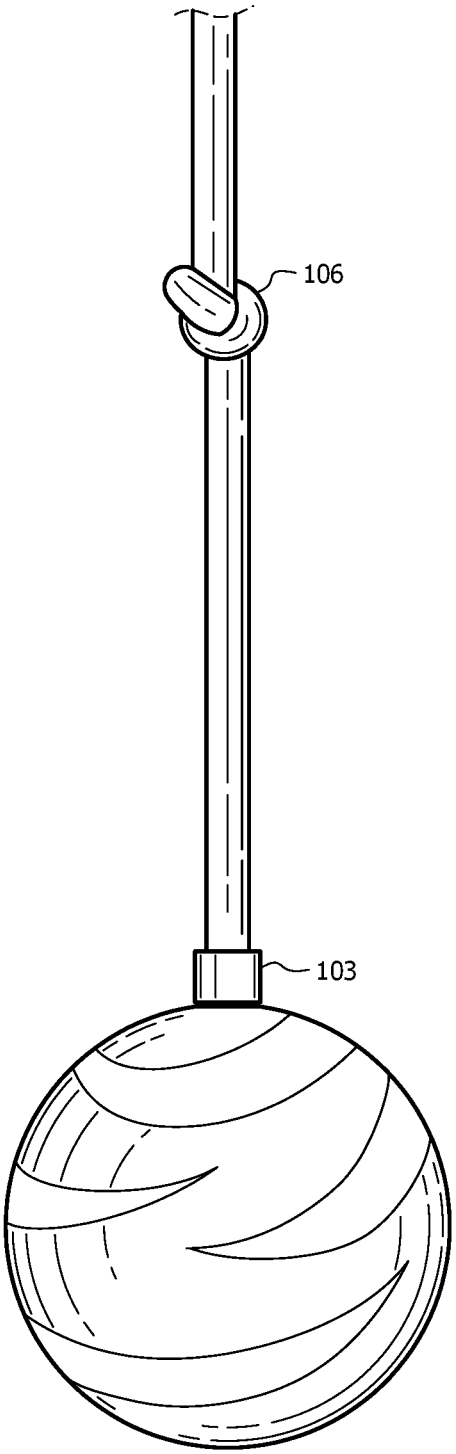
FIG. 6 is a side view of a completed knot in one embodiment.

The game is fun and challenging, and generally takes several repeated attempts before successfully tying a knot. FIG. 6 is a side view of a completed knot in one embodiment. As shown, a knot 106 is formed along the length of the flexible line 102. More specifically, a knot 106 is formed along the free flexible line and upstream of the weight 101.

Figure 9:
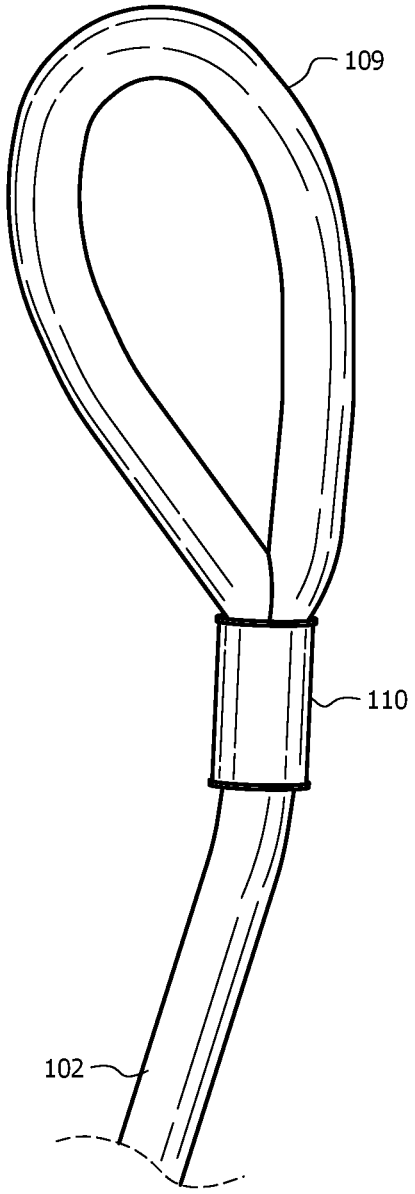
FIG. 9 is a perspective view of a knot game with a loop in one embodiment.

While one embodiment has been described wherein the upstream end of the flexible line 102 comprise fraying, this is for illustrative purposes only and should not be deemed limiting. In other embodiments the distal end of the upstream end of the flexible line 102 is tied into a knot with itself. Thus, the distal end is not frayed but is instead a knot. In other embodiments the distal end comprises a loop. FIG. 9 is a perspective view of a knot game with a loop in one embodiment. The loop 109 is formed when the flexible line 102 is bent along itself at the upstream end to form a loop. The extreme upstream end of the flexible line 102 can be tied in a knot against itself to close the loop or the distal end can be coupled with a housing 110. The housing 110 can comprise any mechanical restrictor which maintains the distal end in the desired configuration—in this case, a loop. The housing 110 can comprise a restrictive diameter which uses friction to secure both the body of the flexible line 102 which intersects and extends through the housing 110 in secured adjacent relationship with the distal end. The housing 110 can employ friction or other methods such as glue, adhesive, or the like. In one embodiment the housing 110 is cramped to secure the loop shape. This can be accomplished by placing both distal end in the housing 110 at the desired location, and then applying an external force upon the housing 110. This cause the diameter of the housing 110 to decrease and ensures the distal end is maintained in the desired relationship in the housing 110.

The housing 110 can comprise virtually any material. It can be a restrictive wire, band, rubber band, washer, nut, etc. As shown the housing 110 is a metallic housing.

The loop 109 is a fun and different way to hold the flexible line 102. In one embodiment the loop 109 diameter is smaller than the diameter of the weight 101, but in other embodiments the loop 109 diameter is greater than the diameter of the weight 101.

Figure 7:
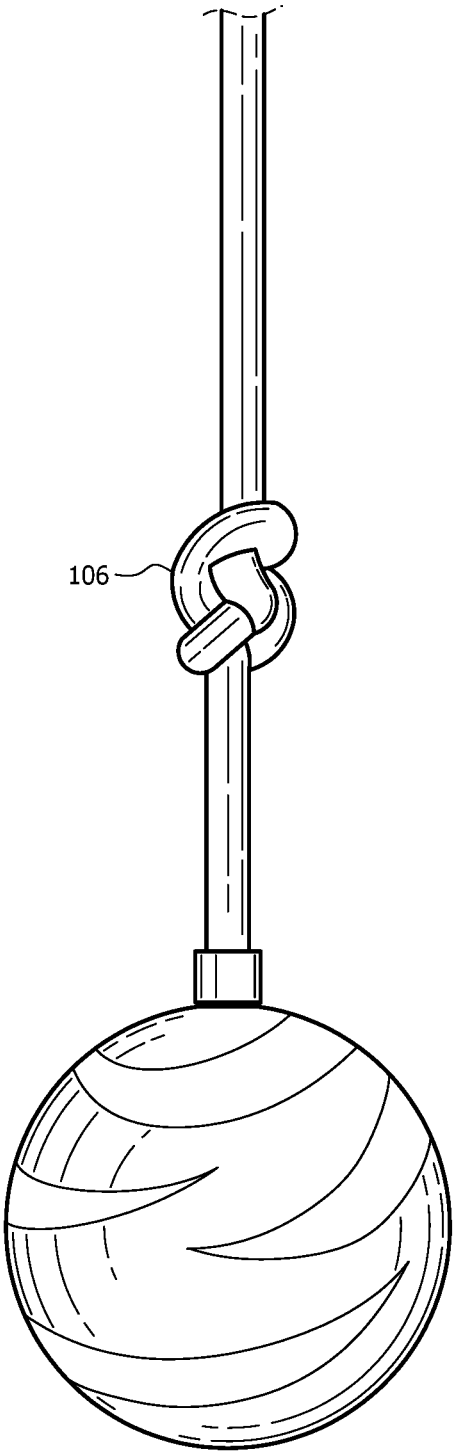
FIG. 7 is a side view of a several completed knots in one embodiment.

While one embodiment has been discussed in reference to completing a single knot, this is for illustrative purposes only and should not be deemed limiting. In other embodiments, the user ties many knots. FIG. 7 is a side view of a several completed knots in one embodiment. The weight and flexibility of the flexible line 102 is altered when a knot has been completed. Thus, the user may have to adapt their movements to complete a second and subsequent knots. Thus, the game can be first to tie five knots, as an example.

In one embodiment a first user uses the method discussed herein to tie a first knot. The user is timed. Thereafter, a second user uses the method to tie a second knot, and the second user is tied. The goal is to see who can tie a knot in the least amount of time.

In other games, the first and second users are allotted a specified amount of time and the users attempt to tie as many knots as possible in their allotted time. Note while first and second users are discussed, virtually any number, including more than two users, can play the game.

In another game, the first user ties a knot. The location of the knot relative to either the end of the flexible line or the weight is measured. The knot is undone, and a second user ties a knot which is then similarly measured. The goal of the game can either be to tie a knot closest or furthest from the weight.

While the game is fun and challenging, it is also an aid for anxiety, depression, nervous energy, etc. Fidget spinners and other devices are popular because they provide user with an outlet for their nervous energy. Other people twirl pens or other items for distraction. As noted, however, the fidget spinner, as an example, is simply a time killer. There is, generally, no goal or challenge. Likewise, there is no reward to be obtained. In this manner, the knot game has benefits because it offers a feeling of accomplishment when a knot is obtained. A user with nervous energy can utilize the knot game and focus their energy on attempting to tie the knot. When they succeed, the user gets a positive feeling of accomplishment.

One benefit of the game is that it can be played virtually anywhere. The game can fit in a user's pocket and be carried on the bus, to school, at the office, etc. The user can play the game, and then share with friends. Various games and scoring methods can be built upon the game.

While the invention has been particularly shown and described with reference to a preferred embodiment, it will be understood by those skilled in the art that various changes in form and detail may be made therein without departing from the spirit and scope of the invention.

What is claimed is:

1. A method of playing a game with at least a first user, the game comprising the steps of:

providing an apparatus, the apparatus comprising:

a flexible line having an upstream end and a downstream end; and a weight coupled to said downstream end of said flexible line;

said at least first user carrying out the steps of:

a) holding the apparatus and gripping said flexible line at a position upstream from said weight;

b) causing said weight to create tension in said flexible line;

c) applying an upward force on said flexible line to create slack causing the weight to move upward;

d) bouncing the weight upward so that a knot is formed along the length of said flexible line.

2. The method of playing a game of claim 1 wherein said flexible line comprises a threaded connector, and a coupler, positioned downstream from said connector, and wherein said connector comprises a male threading, and said coupler comprises a female threading, said female threading of the coupler receives the male threading of the connector, and wherein said weight comprises a receiver for receiving said coupler.

3. The method of playing a game of claim 1 wherein said game providing a timer, and wherein the at least first user is a first and second user, the game further includes the step of:

conducting the game between said first user and said second user;

timing said first user when carrying out steps a) through d);

timing said second user when carrying out steps a) through d); and determining which of the first or second user had the lowest time for carrying out steps a) through d).

4. A method of playing a game by conducting a competitive game between at least a first user and a second user, the game comprising the steps of:

providing an apparatus, the apparatus comprising:

a flexible line having an upstream end and a downstream end; and a weight coupled to said downstream end of said flexible line;

said at least first user carrying out the steps of:

a) holding the apparatus and gripping said flexible line at a position upstream from said weight;

b) causing said weight to create tension in said flexible line;

c) applying an upward force on said flexible line to create slack causing the weight to move upward;

d) bouncing the weight upward so that a first knot is formed along the length of said flexible line;

measuring the position of said first tied knot from the bottom of the weight, and recording the measured distance for the first tied knot;

said second user carrying out the steps of:

a) through d);

measuring the position of said second tied knot from the bottom of the weight, and recording the measured distance for the second tied knot; and determining if the first or second knot is closest or alternatively furthest from the weight.

5. The method of playing a game of claim 4 further comprising the step of untying said first knot prior to said second user tying said second knot.

6. The method of playing a game of claim 1 wherein the at least first user is a first and second user, the method further including the steps of:

providing a timer;

conducting the game between said first user and said second user;

timing said first user carrying out steps a) through d) and repeating step a) through d) in the allotted time;

timing said second user carrying out steps a) through d) and repeating step a) through d) in the allotted time; and determining which of the first or second users tied the most knots in the allotted time.

* * * * *